US008561370B1

(12) United States Patent
Hoffman et al.

(10) Patent No.: US 8,561,370 B1
(45) Date of Patent: Oct. 22, 2013

(54) METHOD AND APPARATUS FOR APPLYING LIPPAGE REDUCING FORCES TO AN ARRAY OF ADJACENT TILES

(71) Applicant: New Standards Manufacturing Co., Keokuk, IA (US)

(72) Inventors: James P. Hoffman, Keokuk, IA (US); Ernest L. Perry, IV, Vinton, IA (US); Michele Volponi, Keokuk, IA (US)

(73) Assignee: New Standards Manufacturing Co., Keokuk, IA (US)

( * ) Notice: Subject to any disclaimer, the term of this patent is extended or adjusted under 35 U.S.C. 154(b) by 0 days.

(21) Appl. No.: 13/855,537

(22) Filed: Apr. 2, 2013

Related U.S. Application Data

(62) Division of application No. 13/707,369, filed on Dec. 6, 2012, which is a division of application No. 13/296,737, filed on Nov. 15, 2011, now Pat. No. 8,429,878.

(51) Int. Cl.
*E04B 1/00* (2006.01)
*E04G 21/00* (2006.01)

(52) U.S. Cl.
USPC ..... 52/747.11

(58) Field of Classification Search
USPC ..... 52/58, 60, 302.5, 302.6, 631, 716.2, 52/741.4
See application file for complete search history.

(56) References Cited

U.S. PATENT DOCUMENTS

| | | | |
|---|---|---|---|
| 1,918,228 | A | 7/1933 | Spencer |
| 2,277,892 | A | 3/1942 | Swenson |
| 3,511,001 | A | 5/1970 | Morgan |
| 4,397,125 | A | 8/1983 | Gusler |
| 5,345,990 | A | 9/1994 | Potts |
| 5,603,195 | A | 2/1997 | Cosentino |
| 5,675,942 | A | 10/1997 | Crawford |
| 5,843,546 | A | 12/1998 | Eichhorn |
| 6,253,515 | B1 | 7/2001 | Kuelker |
| 7,257,926 | B1 | 8/2007 | Kirby |
| D552,266 | S | 10/2007 | Murdock |
| 7,621,100 | B2 | 11/2009 | Kufner et al. |
| D621,966 | S | 8/2010 | Vaes |
| D630,077 | S | 1/2011 | Kufner et al. |
| D630,078 | S | 1/2011 | Kufner et al. |

(Continued)

FOREIGN PATENT DOCUMENTS

| | | | |
|---|---|---|---|
| JP | 07-305494 | A | 11/1995 |
| WO | PCT/US2012/055482 | | 9/2012 |

OTHER PUBLICATIONS

Kufner et al, The Lippage-Free Tile System, Web (www.tuscanleveling.com), 2006, Fairfield, IA.

*Primary Examiner* — Joshua J Michener
*Assistant Examiner* — Keith Minter
(74) *Attorney, Agent, or Firm* — Simmons Perrine Moyer Bergman PLC

(57) ABSTRACT

A tile aligning and leveling method and system that uses an under tile base re-usable upright connecting tab, which is detachably connected to said under tile base, a re-usable flexible edge slotted cap, configured to slip over the connecting tab and latch thereto, as the cap is slid further down the connecting tab. The cap has an edge slot so that the connecting tab can be separated from the cap, by merely sliding the cap, so that the connecting tab passes through the slot. A flexible spring-like portion of the cap provides increased force on the tile even if undesired elongation of the connecting tab occurs.

19 Claims, 5 Drawing Sheets

(56) References Cited

U.S. PATENT DOCUMENTS

| | | | |
|---|---|---|---|
| 7,861,487 | B2 | 1/2011 | Kufner et al. |
| 7,946,093 | B1 | 5/2011 | Sturino |
| D640,119 | S | 6/2011 | Kufner et al. |
| 7,954,300 | B1 | 6/2011 | Kufner et al. |
| 7,992,354 | B2 | 8/2011 | Doda |
| 8,079,199 | B1 | 12/2011 | Kufner et al. |
| D658,963 | S | 5/2012 | Kufner et al. |
| 2006/0185269 | A1 | 8/2006 | Kufner et al. |
| 2006/0185319 | A1 | 8/2006 | Kufner et al. |
| 2010/0263304 | A1 | 10/2010 | Comas |
| 2010/0287868 | A1 | 11/2010 | Kufner et al. |
| 2011/0011031 | A1 | 1/2011 | Kufner et al. |
| 2011/0265424 | A1 | 11/2011 | Kufner et al. |
| 2012/0085066 | A1 | 4/2012 | Kufner et al. |

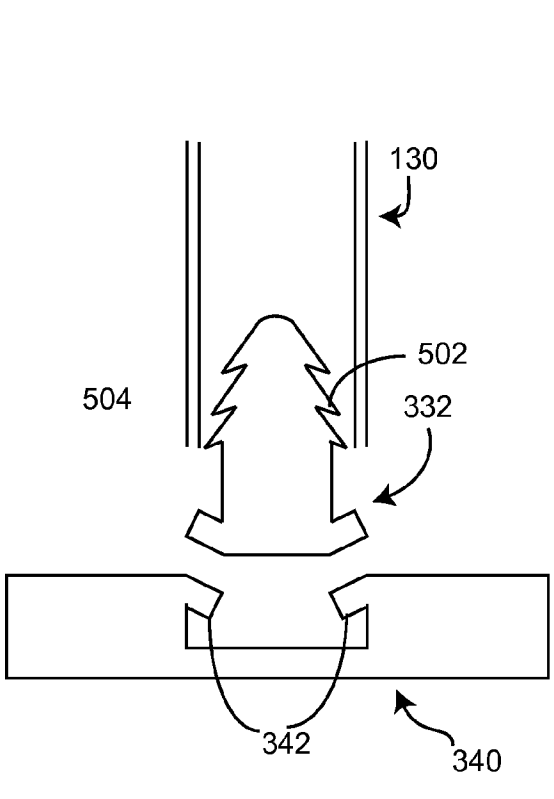
FIG. 6
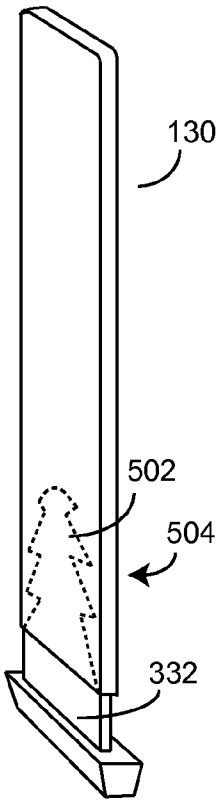
FIG. 5
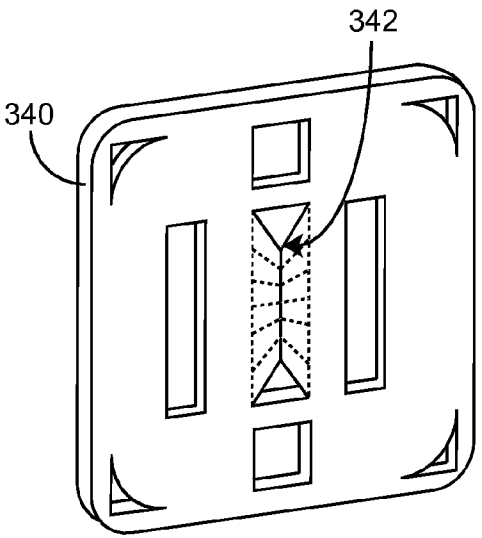

METHOD AND APPARATUS FOR APPLYING LIPPAGE REDUCING FORCES TO AN ARRAY OF ADJACENT TILES

BACKGROUND OF THE INVENTION

This invention relates to systems and methods for laying tile and, more specifically, for efficiently reducing tile lippage. Throughout this description, the term tile is used as an example of various matter, which is arranged disposed adjacent a substrate (which can be horizontal—floors or vertical—walls or other) in multiple pieces. The term tile should be understood to include panels, sheets, boards, paving stones, bricks or the like. The present invention relates more specifically to improved methods and systems which use tab systems to align and level tiles.

U.S. Pat. No. 7,861,487 and U.S. Design Pat. D63077 and the web site www.tuscanleveling.com describe a system for aligning and leveling tiles. While such systems have enjoyed some success in the past, they do have drawbacks. At the conclusion of each job, the vertical shafts extending upwardly between the tile joints in such design are broken away from the base and discarded. This generates waste that may be disposed in landfills. In addition, the act of breaking away the shaft from the base can be time consuming, and it can disturb the tiles, if it is not done properly, or if the tile is not sufficiently adhering to desired substrate.

Consequently, there is a need for improvement in tile aligning and leveling systems and methods.

SUMMARY OF THE INVENTION

More specifically, an object of the invention is to provide a cost-effective tile aligning system.

It is a feature of the present invention to include reusable connecting tabs or shafts.

It is an advantage of the present invention to decrease the materials that are consumed, or disposed of, for each job.

It is another feature of the invention to include a cap system that is detachable from the tab or shaft, while it remains in place attached to the base located under the tile.

It is also an advantage of the present invention to provide improved ease of use and reduce unwanted dislocation of tiles after desired placement is accomplished.

It is another feature of the present invention to change how pressure is applied to the surface of the tile and the connecting tab.

It is another advantage of the present invention to provide for the ability to maintain lippage reducing forces over a wider range of tab or shaft elongation.

The present invention includes the above-described features and achieves the aforementioned objects.

Accordingly, the present invention comprises a tile-leveling system with a reusable connecting tab; a cap which is easily removable from an attached connecting tab or shaft; or a spring-like cap which provides for variable forces between the cap and the tile, without any change in the separation between base and the tile.

BRIEF DESCRIPTION OF THE DRAWINGS

In the following description of the drawings, in which like reference numerals are employed to indicate like parts in the various views:

FIG. 5 shows a perspective exploded view of the tab and base combination of the present invention, where the dotted lines show underlying structure, which would otherwise not be visible.

FIG. 6 shows a cross-section, exploded view of the tab and base combination of FIG. 5.

DETAILED DESCRIPTION OF THE DRAWINGS

Figure 1:
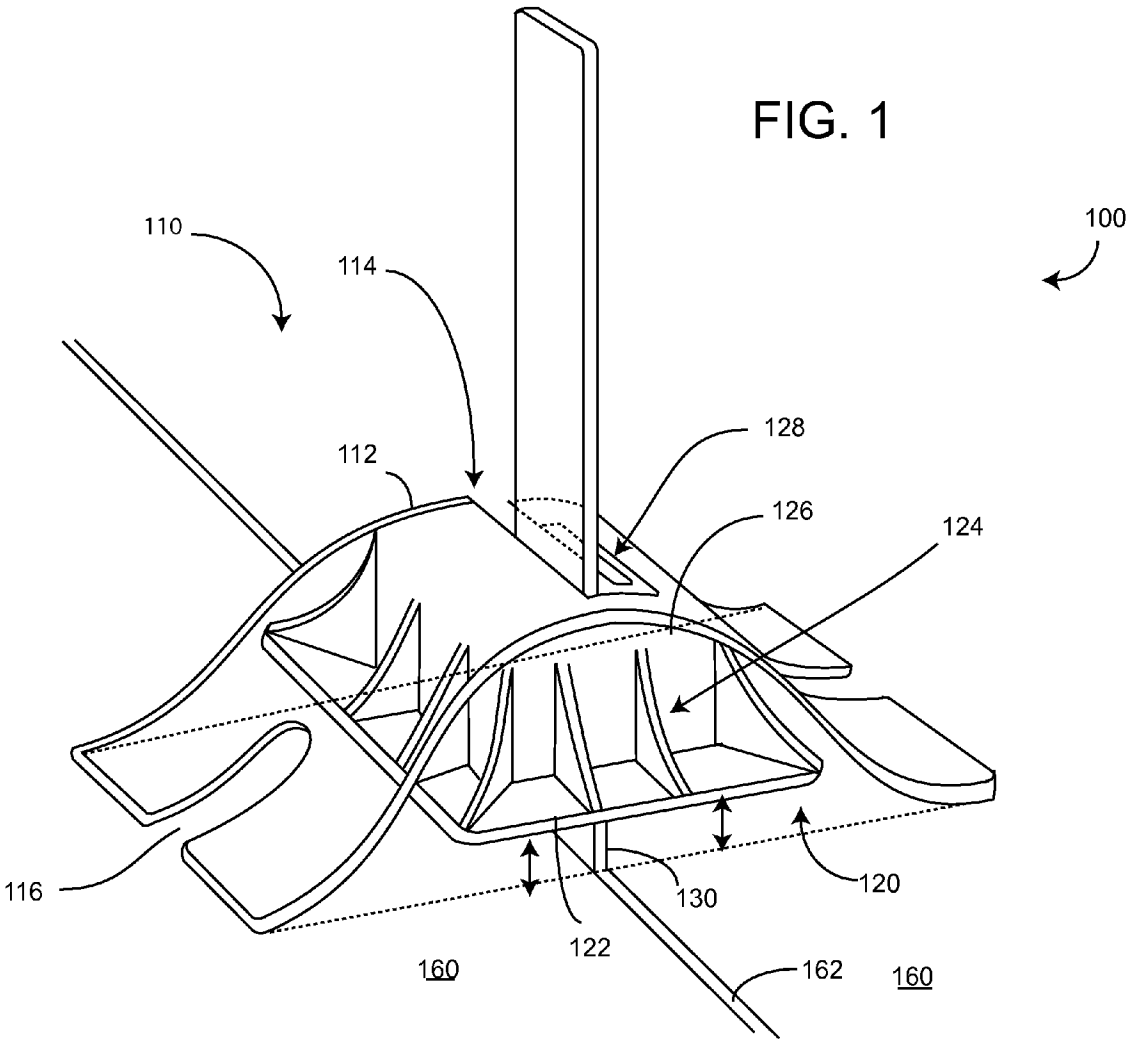
FIG. 1 is a perspective, partially transparent, view of the tile alignment and leveling system of the present invention, in its intended environment, when a relatively low pressure is applied.
Figure 2:
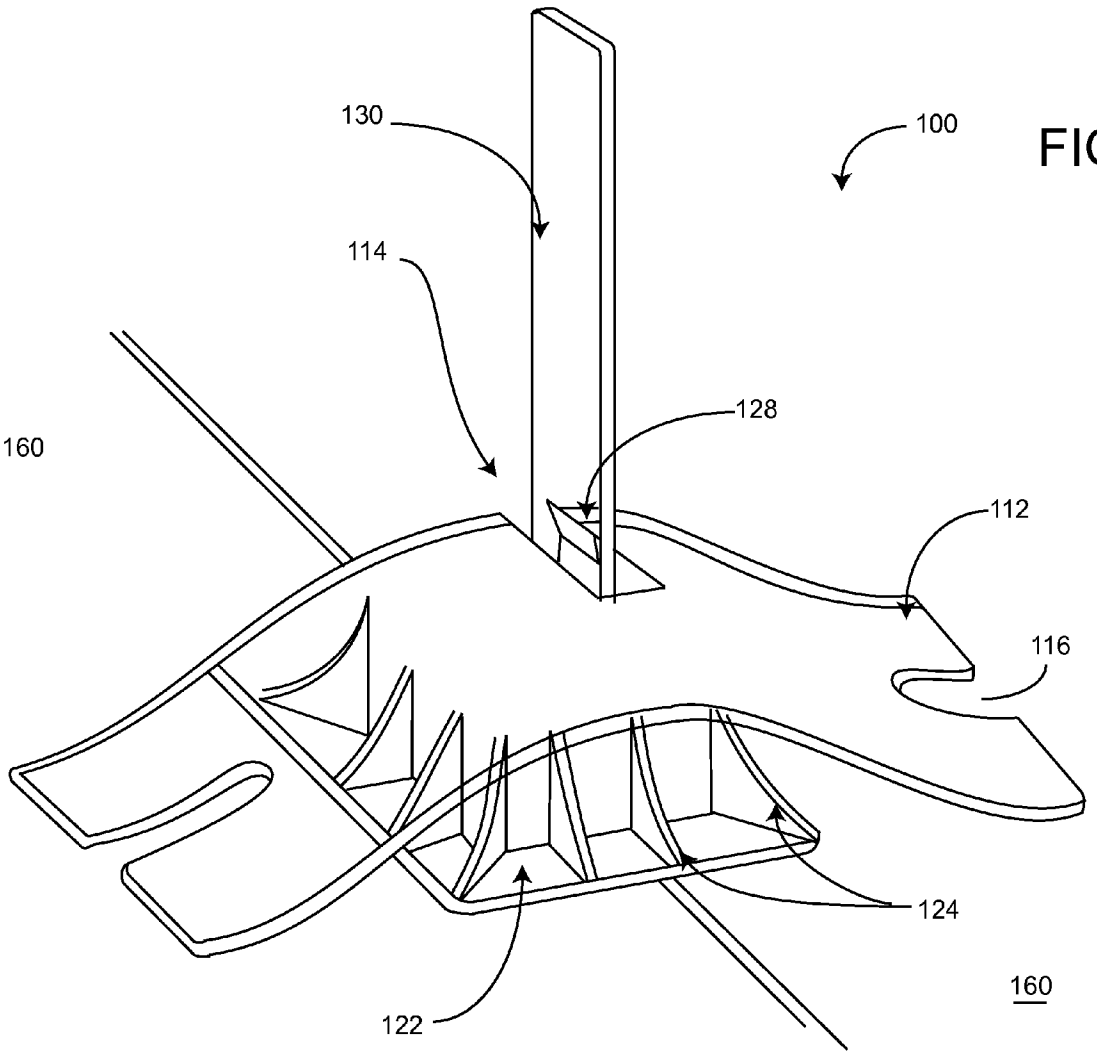
FIG. 2 is a perspective, partially transparent, view of the tile alignment and leveling system of FIG. 1, when a relatively higher pressure is applied.
Figure 3:
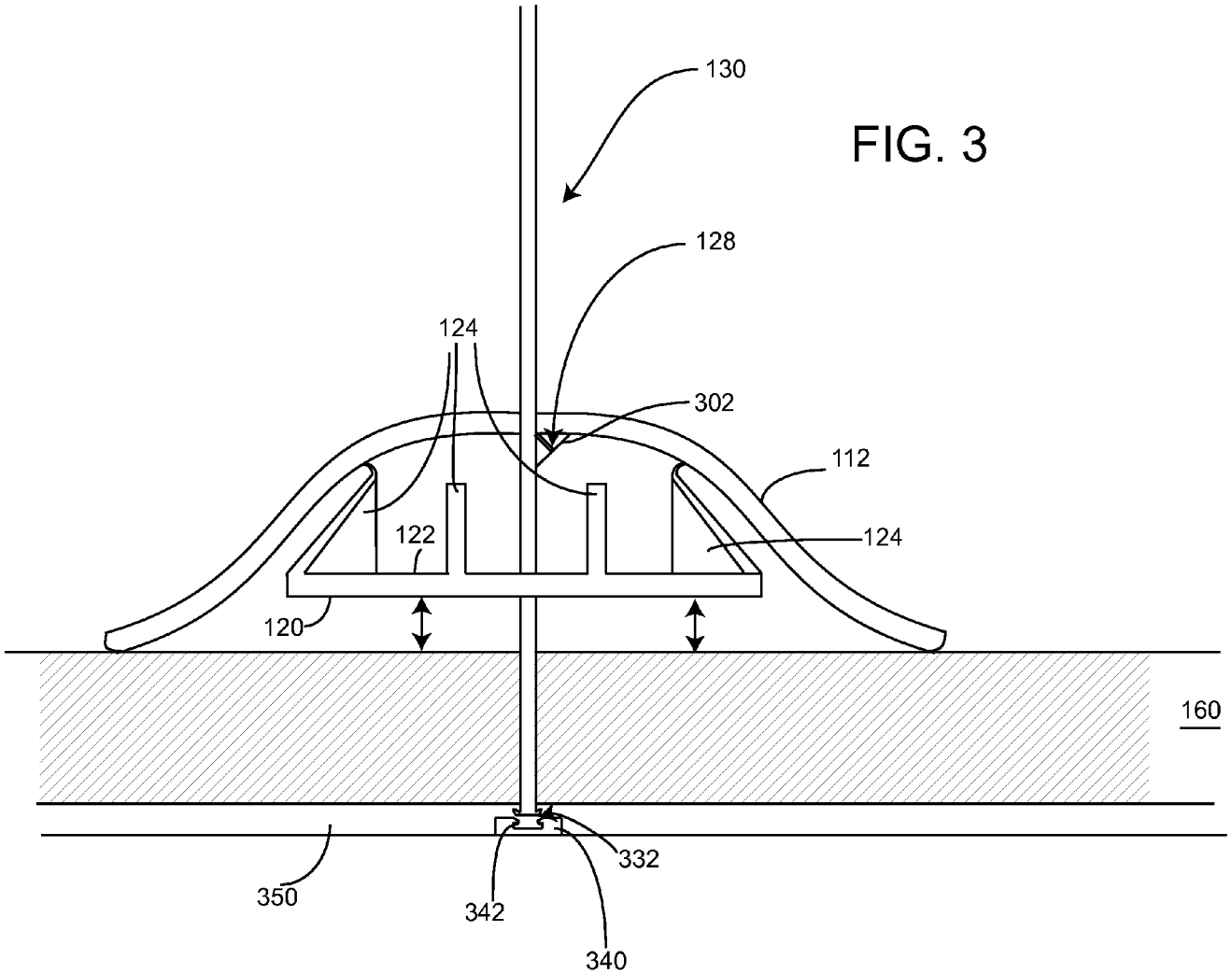
FIG. 3 shows a cross-sectional view of portions of the system, as shown in FIG. 1.

Referring now to the drawings, where like numerals refer to like matter throughout, and more particularly to FIG. 1, there is shown a tile alignment and leveling system 100, which generally includes a cap system 110 and a connecting tab 130, which is disposed on the finished side of an array of tiles 160, with a joint 162 therebetween. Cap system 110 is shown having an upper cap spring-like portion 112 and a cap base portion 120. These may be a single piece, or multiple pieces of the same or dissimilar material. Upper cap spring-like portion 112 needs to be resilient, so as to act like a spring when compressed downward toward the tile. Note that upper cap spring-like portion 112 is shown in FIGS. 1 and 2 as being partially transparent, so that the details of cap base portion 120 can be seen. Cap base portion 120 need not be as resilient, but may be, if so desired. Cap system 110 and connecting tab 130 may be made of similar materials as prior art systems, such as described in the above referenced patent. However, connecting tab 130 may be made of metal or plastic or rubber coated metal. Upper cap spring-like portion 112 includes an innovative edge tab removal slot 114, which allows for separation of the connecting tab 130 from the cap system 110, while the connecting tab 130 remains coupled to the sub tile base member 340 (FIG. 3). When cap system 110 is moved away, (e.g. slid in one direction) the connecting tab 130 passes through the edge tab removal slot 114 and detachment occurs, while connecting tab 130 remains in place. Note this can occur in the configuration of FIG. 1 or FIG. 2. It is not necessary to tip the cap system 110, and thereby increase the pressure at the pivot point, and increase the potential for unwanted and potentially disruptive forces on the tile. Cap system 110 can be merely slid out of the way, and the connecting tab 130 then can be detached, without increasing any pressure on the top surface of the tile. Upper cap spring-like portion 112 also has an optional slot 116. Disposed underneath the upper cap spring-like portion 112 is cap base portion 120, which provides increased surface area for contact between the cap system 110 and the tile. Cap base buttress 124 provides support for the cap base portion core 126, which is located centrally in cap base portion 120. Also located in cap system 110 is gripping tongue 128, which is configured to firmly grip the connecting tab 130. Note that connecting tab 130 does not necessarily require that there be surface features thereon in order to properly function.

One advantage of the present invention over the system of the above-referenced patent is that the upper cap spring-like portion 112 acts like a spring, which can provide a force which tends to hold adjacent tile in the same relative position, despite a stretching or thermal expansion of said connecting tab 130. Note, in the above referenced patent, if the shaft were to become elongated (even in some cases by a very small amount) as a result of stretching or thermal expansion, then the force applied by the cap onto the adjacent tiles could be completely eliminated. The spring-like nature of the upper cap spring-like portion 112 makes it much less likely that enough elongation will occur to eliminate contact. In other words, it is not as likely that the elongation will be sufficient to overcome the amount of deflection of the upper cap spring-like portion 112.

Now referring to FIG. 2, there is shown a tile alignment and leveling system 100 of FIG. 1, which has been pressed downward so that the cap base flange 122 now touches the tile top surface. It can be seen that the contact surface between the cap system 110 and the tile includes both the points of contact between the upper cap spring-like portion 112 and the cap base flange 122. This area of contact can be several times the area of similar contact in the above-described patent.

Now referring to FIG. 3, there is shown the cross-sectional view of the tile alignment and leveling system 100 of FIG. 1. Also shown is gripping tongue support member 302, which is shown as being coupled to the upper cap spring-like portion 112. Note that when upper cap spring-like portion 112 is pressed downward, as in FIGS. 2 and 4, there is deflection of upper cap spring-like portion 112, and therefore relative movement of gripping tongue support member 302/gripping tongue 128 mounted thereon with respect to the connecting tab 130. Also shown in FIG. 3 is the substrate mortar 350 and sub tile base member 340, which is placed in the mortar or against the substrate. Sub tile base member 340 is shown having base mating portion 342 for temporarily grasping the connecting tab base mating member 332 disposed on connecting tab 130. Note that the base mating portion 342 is designed to release the connecting tab base mating member 332, or otherwise disengage contact with the connecting tab 130 when a requisite force or series of forces is applied thereto. In one embodiment, connecting tab base mating member 332 is a portion of a reusable connecting tab that is removed from the sub tile base member 340 on one job and used again and again on other jobs. In such a configuration, only the sub tile base member 340 is a consumable or non-reusable portion of the system. Note connecting tab base mating member 332 is shown in an enlarged or exaggerated manner for clarity in FIGS. 3 and 4. FIGS. 5 and 6 show embodiments where the widest portion of connecting tab base mating member 332 is not any wider than the widest portion of the remainder of connecting tab 130. This allows for removal of the connecting tab 130 with connecting tab base mating member 332 through the joint in the tile, without the need to remove any additional mortar.

Figure 4:
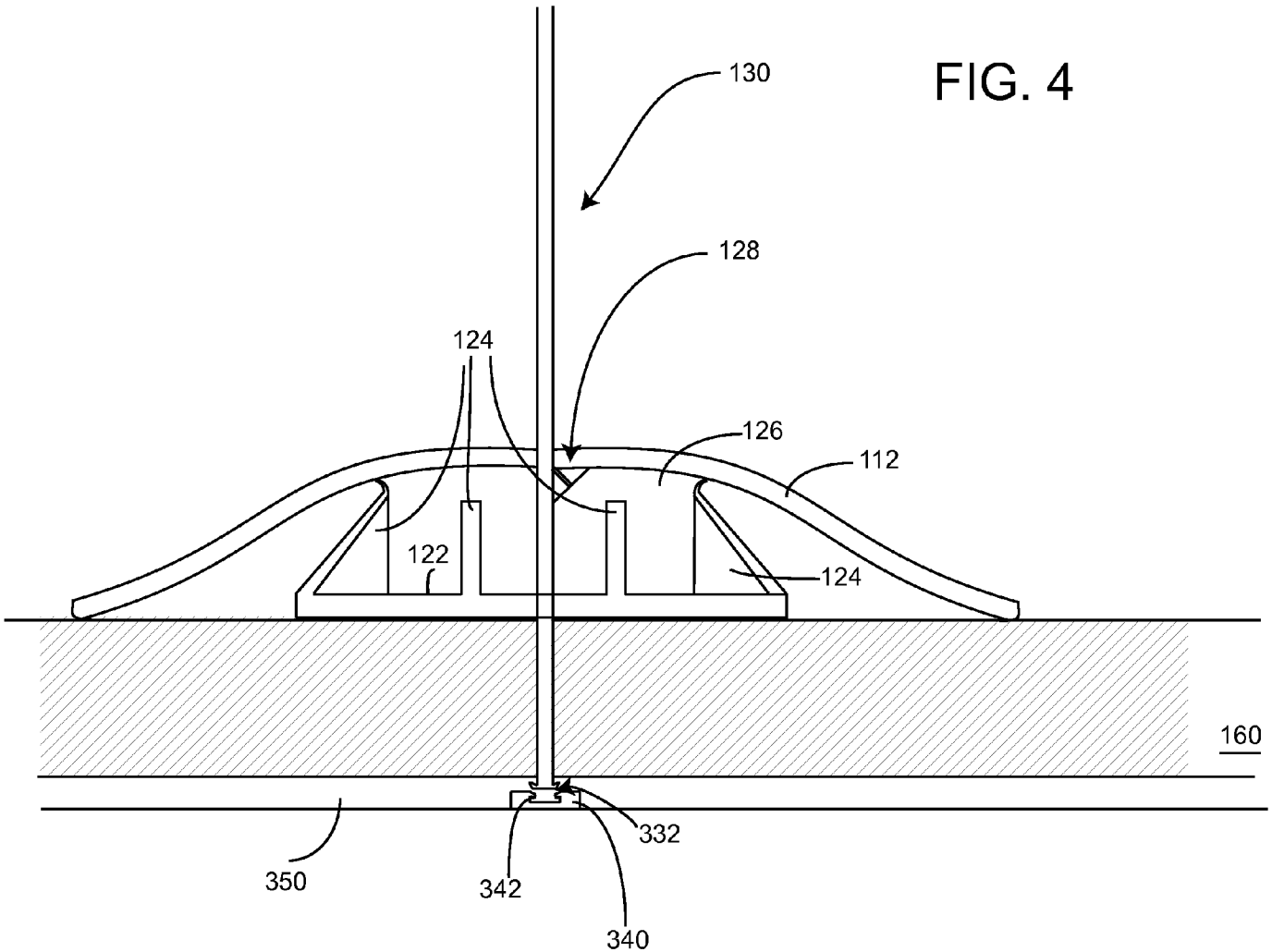
FIG. 4 shows a cross-sectional view of portions of the system, as shown in FIG. 2.

Now referring to FIG. 4, there is shown a cross-sectional representation of the tile alignment and leveling system 100 of FIG. 2, which shows the cap base portion 120 touching the tile 160 and the upper cap spring-like portion 112 spread out further. After the initial contact between cap base flange 122 and tile 160 is fully made, the upper cap spring-like portion 112 is configured to apply a variable force between the cap base flange 122 and tile 160 by deflection of the upper cap spring-like portion 112, and without any movement of the cap base portion 120 or the tile 160.

Now referring to FIG. 5, there is shown an exploded perspective view of the connecting tab 130 and sub tile base member 340 combination of the present invention. Sub tile base member 340 is shown having base mating portion 342, which is designed to temporarily grip connecting tab base mating member 332 and then release when the requisite forces are applied. Connecting tab 130 is shown having a connecting tab base mating member 332, which may be a separate metal piece inserted into a connecting tab end opening 504 so that connecting tab mating member internal gripping teeth 502 (shown in dotted lines) hold the connecting tab base mating member 332 in place, with respect to the connecting tab 130.

Now referring to FIG. 6, there is shown an exploded cross-sectional view of the connecting tab 130 and sub tile base member 340 combination of the present invention.

In operation, the system of the present invention utilizes the following method:

The reusable connecting tab 130 is coupled to the sub tile base member 340. The system is used to align and level tile in a manner similar to the system described in the above referenced patent, except for the flexing of upper cap spring-like portion 112 after the cap base flange 122 contacts the tile.

In the present invention, the upper cap spring-like portion 112 may be, but is not necessarily, compressed and deflected when pressed toward the tile 160. This additional compression of cap system 110, after contact between the cap base flange 122 and the tile, provides the force retaining feature to avoid problems associated with undesired elongation of the connecting tab 130.

At the desired time, (e.g. after the mortar is set) the cap system 110 can be removed from the surface of the tile 160, without tipping the cap system 110 and temporarily increasing the forces between the cap and the tile. Instead, the cap system 110 is merely slid away from the connecting tab 130, while the connecting tab 130 remains coupled to the sub tile base member 340. After the cap system 110 has been separated from the connecting tab 130, the re-usable connecting tab 130 is removed from the sub tile base member 340, without the need for increasing downward pressure on portions of the top surface of the tile 160.

The process is repeated for all of the connecting tab 130 and cap system 110 combinations utilized for the job, and the re-useable connecting tabs 130 are cleaned and stored for future re-use.

It is believed that, when these teachings are combined with the known prior art by a person skilled in the art of the prior art systems, many of the beneficial aspects and the precise approaches to achieve those benefits will become apparent.

It will be understood that certain features and sub-combinations are of utility and may be employed without reference to other features and sub-combinations. This is contemplated by and is within the scope of the claims.

Since many possible embodiments may be made of the invention without departing from the scope thereof, it is understood that all matter herein shown in the accompanying drawings is to be interpreted as illustrative and not in a limiting sense.

Throughout these claims the term lippage is used and is hereby defined as meaning relatively uneven edges existing with respect to adjacent tiles arranged in an array.

We claim:

1. A tile aligning and leveling system comprising:

a re-useable connecting tab;

a first sub tile base member, sized and configured to be placed adjacent to a plurality of tiles, said sub tile base member having a void therein, which is configured to temporarily receive and retain therein a portion of said re-useable connecting tab;

said first sub tile base member, further having a member thereon, which is sized and configured to release said re-useable connecting tab when a force is applied to said re-useable connecting tab; where the force causes no harm to a bottom portion of said re-useable connecting tab and allows said re-useable connecting tab to be detached from said first sub tile base member and be reused and mated again with a second sub tile base member, which is identical to said first sub tile base member;

a cap system comprising:

an upper cap spring portion and a cap base portion, where said upper cap spring portion has an edge tab removal slot therein, which is sized and configured to permit said cap system to be slidingly separated from said re-useable connecting tab, while said connecting tab remains coupled to said sub tile base member; and said upper cap spring portion being configured, so that when pressed toward said sub tile base member, a deflection in said upper cap spring portion occurs, thereby creating a force which is applied across the adjacent tiles.

2. The system of claim 1 wherein said re-useable connecting tab comprises a base member and a detachable elongated shaft member.

3. The system of claim 2 wherein said base member is configured to mate with a void in said detachable elongated shaft member.

4. The system of claim 3 wherein said base member has gripping teeth configured to mate with an inside surface of said void.

5. The system of claim 4 wherein said base is metal and comprises a connecting tab base mating member, which is configured to mate with a base mating portion of said first sub tile base member.

6. The system of claim 1 further comprising a cap base portion coupled with said upper cap spring portion.

7. The system of claim 6 wherein said cap base portion comprises a cap base portion core, a cap base flange and a cap base buttress.

8. A tile aligning and leveling system comprising:

a connecting tab;

a sub tile base member, sized and configured to be placed adjacent to a plurality of tiles, said sub tile base member having a void therein, which is configured to temporarily receive and retain therein a portion of said connecting tab; and a cap system comprising:

an upper cap spring portion and a cap base portion, where said upper cap spring portion has an edge tab removal slot therein, which is sized and configured to permit said cap system to be slidingly separated from said connecting tab while said connecting tab remains coupled to said sub tile base member; and said upper cap spring portion being configured so that when pressed toward said sub tile base member, a deflection in said upper cap spring portion occurs thereby creating a force which is applied across the adjacent tiles.

9. The system of claim 8 wherein said connecting tab comprises a base member and a shaft member.

10. The system of claim 9 wherein said base member is configured to mate with said shaft member.

11. The system of claim 10 wherein said base member has gripping teeth.

12. The system of claim 9 wherein said base member is configured to mate with a base mating portion of said sub tile base member.

13. The system of claim 8 further comprising a cap base portion coupled with said upper cap spring portion.

14. The system of claim 13 wherein said cap base portion comprises a cap base portion core, a cap base flange and a cap base buttress.

15. A tile aligning and leveling system comprising:

a tab;

a base, configured to be placed adjacent to a plurality of tiles, said base having a void therein, which is configured to receive therein a portion of said tab; and a cap system comprising:

an upper cap spring portion, and a cap base portion where said upper cap spring portion has a removal slot therein, which is sized and configured to permit said cap system to be slidingly separated from said tab, while said tab remains coupled to said base.

16. The tile aligning system of claim 15 wherein said tab is an elongated member and said base is sized and configured to be placed below tile in a tile floor.

17. The tile aligning system of claim 15 wherein said tab is reusable.

18. The tile aligning system of claim 15 wherein said removal slot extends entirely to an exterior edge of said upper cap spring portion.

19. The tile aligning system of claim 15 wherein said removal slot has a constant opening width dimension.

* * * * *